United States Patent [19]

Zabcik

[11] 4,031,716

[45] June 28, 1977

[54] AUTOMATIC SEQUENTIAL DUAL ACTION SEALING SYSTEM

[76] Inventor: Clarence John Zabcik, 414 W. Cowan Drive, Houston, Tex. 77007

[22] Filed: Dec. 29, 1975

[21] Appl. No.: 644,531

Related U.S. Application Data

[62] Division of Ser. No. 554,453, March 3, 1975.

[52] U.S. Cl. ..... 64/23; 175/321; 285/351; 277/9; 277/53

[51] Int. Cl.[2] ..... E21B 17/00

[58] Field of Search ..... 64/23; 175/293, 321; 285/106, 351; 277/3, 9, 15, 27, 28, 29, 53, 59

[56] References Cited

UNITED STATES PATENTS

| | | | |
|---|---|---|---|
| 2,996,131 | 8/1961 | Greenwood | 175/293 |
| 3,406,537 | 12/1968 | Falkner Jr. | 64/23 |
| 3,504,936 | 4/1970 | Brown et al. | 285/351 |
| 3,588,124 | 6/1971 | Guiard | 277/59 |
| 3,776,558 | 12/1973 | Maurer et al. | 277/9 |
| 3,949,150 | 4/1976 | Mason | 64/23 |

*Primary Examiner*—Samuel Scott
*Assistant Examiner*—Randall Heald
*Attorney, Agent, or Firm*—Arnold, White & Durkee

[57] ABSTRACT

A shock absorbing subassembly with a body, a mandrel slidably and non-rotatively received in the body, dampening means therebetween, an upper seal above the dampening means and a floating seal therebelow for maintaining an oil bath between the body and the mandrel, a primary seal between the body and the mandrel below the floating seal, and a secondary seal actuated upon a predetermined magnitude of leakage past the primary seal to sequentially establish another seal between the body and the mandrel above the primary seal and below the floating seal.

1 Claim, 4 Drawing Figures

AUTOMATIC SEQUENTIAL DUAL ACTION SEALING SYSTEM

This is a divisional of application, Ser. No. 554,453, filed Mar. 3, 1975.

BACKGROUND OF THE INVENTION

This invention relates generally to seals, and more particularly to an automatic sequential dual action sealing system especially useful in a shock absorbing subassembly used in a downhole oil well drilling.

Shock absorbing subassemblies, such as that disclosed in U.S. Pat. No. 3,406,537 issued to C. B. Falkner, Jr. on Oct. 22, 1968, have been used for many years to absorb shock and vibration between a drill bit and a drill string. However, such shock absorbing subassemblies have been limited insofar as the pressure of the drilling fluid is concerned and insofar as their useful lives are concerned, both limitations being due at least in part to the sealing systems heretofore used. The present invention which arose in the context of the need for a better sealing system in a downhole tool, particularly a shock absorbing subassembly requiring a high pressure seal between telescoping male and female cylindrical members which undergo limited relative axial movement, is not limited to such applications; rather, it is useful in providing an effective seal between male and female cylindrical members in general.

Dual seals per se have been disclosed in U.S. Pat. Nos. 3,588,124 and 3,776,588. However, the first of those is not automatic, and the second requires very complex structure. The present invention provides a simple automatic sequential dual action system. Other references of general interest for background purposes are U.S. Pat. Nos. 2,786,534, 3,504,936, 3,752,507, and 3,807,513.

SUMMARY OF THE INVENTION

Briefly, this invention comtemplates a primary seal between male and female cylindrical members and a secondary seal in the form of a sliding piston with a small orifice therethrough so that small leaks past the primary seal will pass through the orifice and large leaks will cause the piston to slide to a second position where it will establish a second seal.

BRIEF DESCRIPTION OF THE DRAWINGS

A more complete appreciation of the invention and many of the attendant advantages thereof will be readly appreciated as the same becomes better understood by reference to the following detailed description when considered in connection with the accompanying drawings wherein.

DESCRIPTION OF THE PREFERRED EMBODIMENTS

Figure 1:
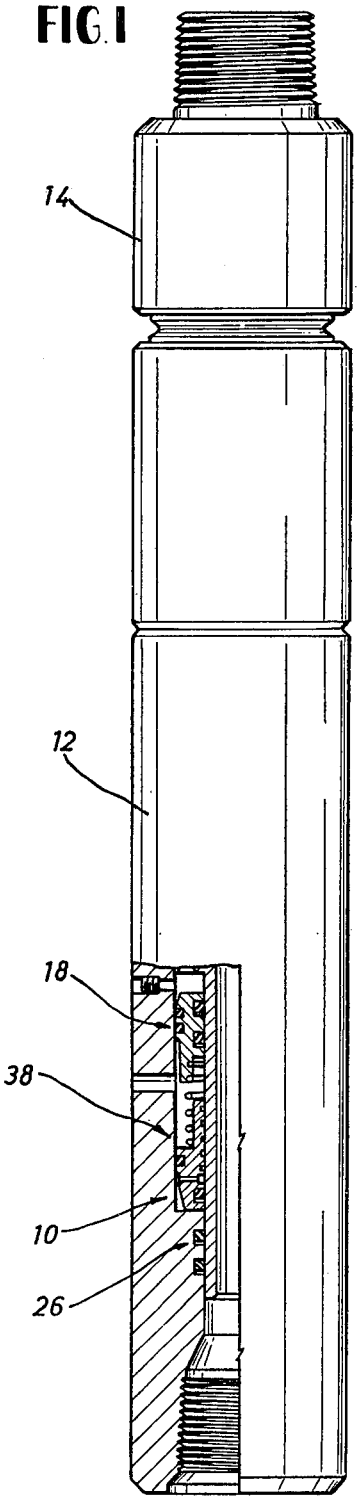
FIG. 1 is an elevation view, partly in section, of a shock absorbing subassembly in accordance with the present invention.

Referring now to the drawings wherein like reference characters designate identical or corresponding parts throughout the several views, and more particulary to FIG. 1 thereof wherein the dual action sealing system of the present invention, indicated generally by reference numeral 10, is shown embodied in a shock absorbing subassembly of the type disclosed in U.S. Pat. No 3,406,537 issued to C. B. Falkner, Jr. on Oct. 22, 1968.

Figure 3:
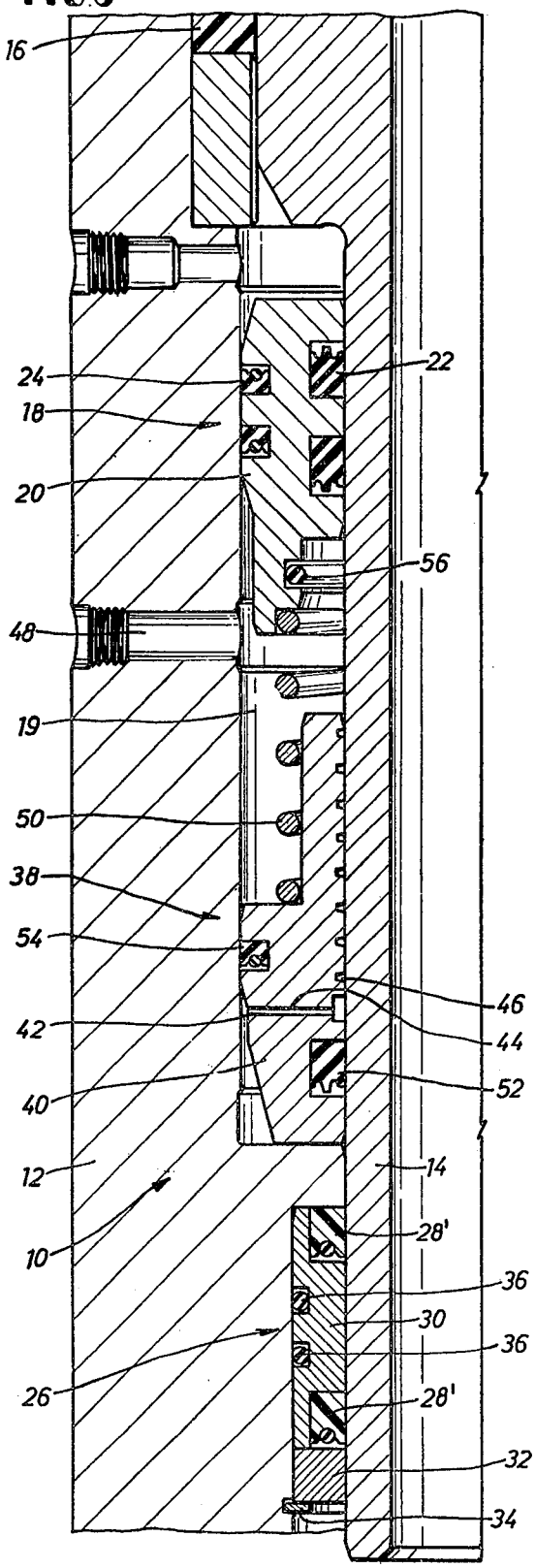
FIGS. 3 and 4 are enlarged elevation views, in section, of a portion of a shock absorbing subassembly with another embodiment of the automatic sequential dual action sealing system of the present invention in its first and second stages, respectively.
Figure 4:
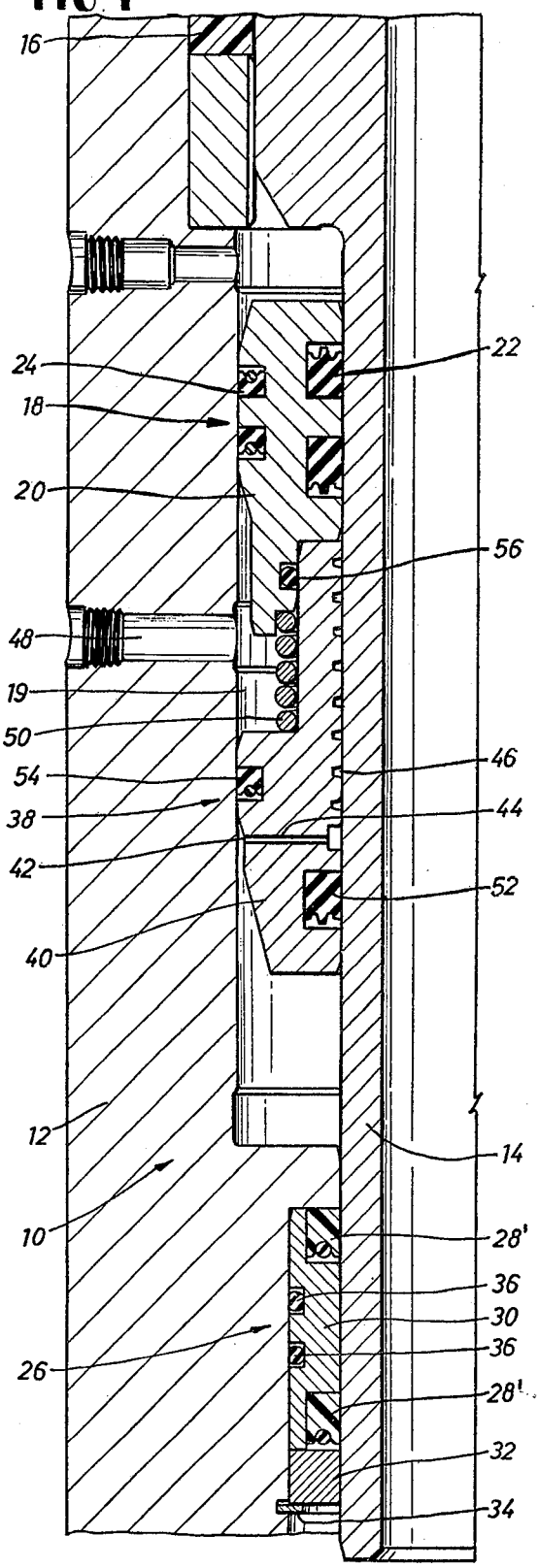

The shock absorbing subassembly, described in greater detail in the aforementioned patent hereby incorporated by reference herein, includes a body or female cylindrical member 12 in which is slidably and non-rotatively positioned a mandrel or male cylindrical member 14. As shown in FIGS. 3 and 4, a dampening means 16 between the body and the mandrel is maintained in a protective oil bath by means of (a) an upper seal means (not shown) for providing a fluid tight seal between the body and the mandrel above the dampening means and (b) a floating seal means 18 positioned in an annular cylindrical chamber 19 between the body and the mandrel for providing a flluid tight seal therebetween below the dampening means.

Floating seal means 18 includes an annular piston 20 having a plurality of inner seals 22 and outer seals 24 positioned in internal and external annular grooves formed in the piston. Seals 22 and 24 may be selected from a number of standard, commercially available seals, such as those sold by Johns-Manville and Parker under the trademarks Deep Base Uneepac and Poly-Pack.

Figure 2:
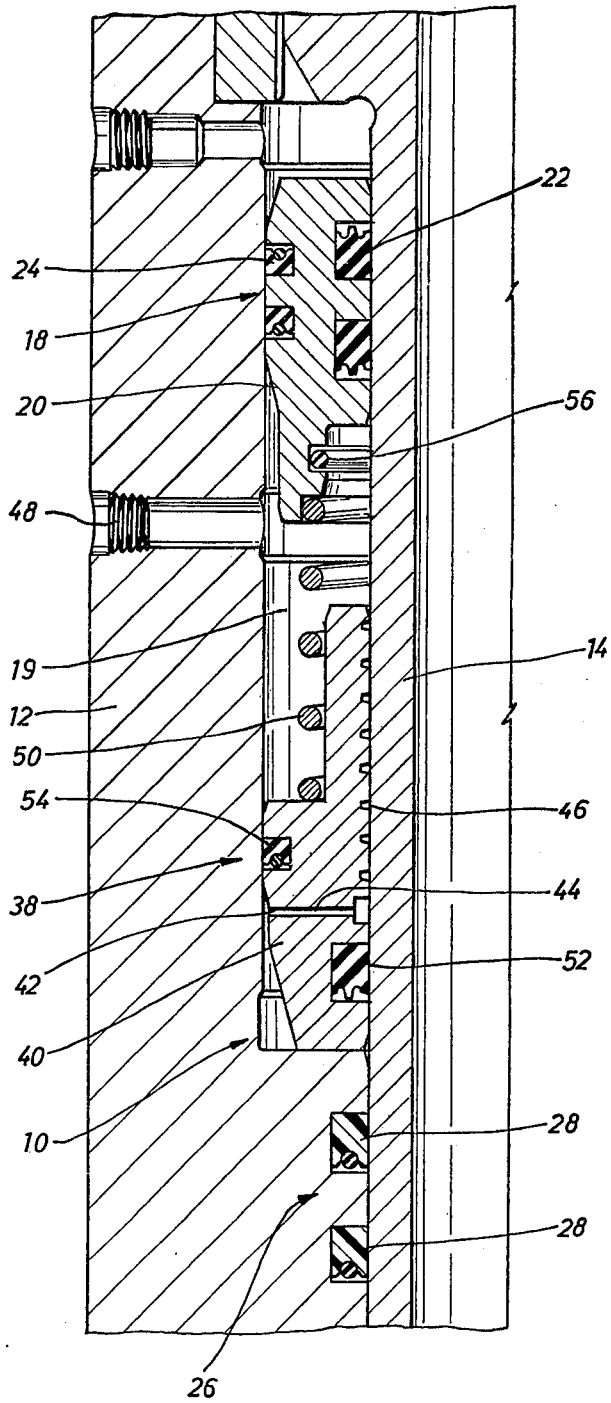
FIG. 2 is an enlarged elevation view, in section, of a portion of a shock absorbing subassembly with one embodiment of the automatic sequential dual action sealing system of the present invention.

Referring now to the embodiment shown in FIG. 2 there is shown a primary sealing means 26 for providing a fluid tight seal between body 12 and mandrel 14. Primary sealing means 26 includes a plurality of conventinal seals 28 which may be of the aforementioned type. If seals 28 are fairly soft and pliable, they may be easily inserted ln internal annular grooves in body 12 as shown in FIG. 2. If sealing means 26 includes a plurality of hard and rigid seals 28, it may be desirable, in order to facilitate assembly, to utilize the embodiment shown in FIGS. 3 and 4. As shown in FIGS. 3 and 4, body 12 may be counterbored so that seals 28' may be inserted on opposite ends of an internally relieved spacer 30 which is held in place by spacer 32 and split lock ring 34. A plurality of suitable seals, such as O-rings 36, may be used to effect a fluid tight seal between spacer 30 and body 12.

The purpose of primary sealing means 26 is to effect a fluid tight seal between body 12 and mandrel 14 so as to prevent the high pressure drilling fluid inside the mandrel from passing through the annular space between the mandrel and the body. The present invention does not reside in the primary sealing means itself, and other types of sealing means may be used as the primary sealing means.

The present invention contemplates a secondary sealing means 38 in combination with primary sealing means 26 to provide a sequential dual action sealing system whereby the secondary sealing means is operable only after the primary sealing means has failed and the fluid flow rate past the primary sealing means has exceeded a predetermined magnitude.

Referring now to FIGS. 3 and 4 in particular there is shown an annular piston 40 slidably positioned in cylindrical annular chamber 19 between a first position at or near the lower end of chamber 19 as shown in FIG. 3 and a second position shown in FIG. 4. Piston 40 is provided with one or more orifices 42 in the form of a radial bore 44 and an internal spiral annular groove 46 so that minor leakage past primary sealing means 26 will pass through the piston, into the larger portion of chamber 19, and out a fluid outlet 48 in body 12, without overcoming the bias provided by compressed coil spring 50. However, once the leakage past the primary sealing means exceeds a predetermined magnitude, piston 40 will slide from its first position shown in FIG. 3 to its second position shown in FIG. 4 Under many conditions it may be unnecessary to use any spring biasing means since the effect of gravity on the piston may provide sufficient bias toward the first position.

When piston 40 reaches its second position a fluid tight seal is once again established by inner and outer seals 52 and 54, which may be of the type previously discussed, and seal 56 between piston 40 and piston 20, which may be an O-ring. When piston 40 is in its second position, fluid outlet 48 is once again sealed off.

It should be noted that, with the use of orifice 42, seals 52, 54, and 56 are not subjected to any substantial pressure load until primary sealing means 26 has failed to the point where leakage is significant. Thus, secondary sealing means 38 is held in reserve until it must be used, thereby providing a sequential dual action sealing system having a long useful life.

One advantage of the present invention, unique to its use in a shock absorbing subassembly, centers around the primary sealing means. Without the use of the primary sealing means, the pressure inside the mandrel is exposed to the floating seal which has a substantial thransverse area, thereby producing a large force tending to compress the dampening elements and the shock absorbing subassembly. Using the primary sealing means, the pressure inside the mandrel is exposed to a much smaller transverse area, thereby producing a lower compression force for the same internal pressure. Thus, use of the primary sealing means enables the shock absorbing subassembly to be used at high drilling fluid pressures.

Obviously, numerous modifications and variations of the present invention are possible in the light of the present invention. In particular, it should be apparent that the sequential dual action sealing system of the present invention may be useful in (a) downhole tools other than the illustrated shock absorbing subassembly and (b) apparatus other than downhole tools in which it is desirable or necessary to provide a liquid tight seal of a long life between two telescoping tubular members, especially when there is relative axial movement between the members. Similarly it should be apparent that the orifice might exist in a different form or, if small leakages are not desired, there may be no orifice at all. It is therefore to be understood that, within the scope of the appended claims, the invention may be practiced otherwise than as specifically described herein.

What is claimed as new and desired to be secured by Letters Patent of the United States is:

1. In a shock absorbing subassembly including a body, a mandrel slidably and non-rotatively received in the body, means for providing limited relative longitudinal movement therebetween, dampening means between the mandrel and body for absorbing and dampening vibrations and impact loads applied to the body, upper seal means for providing a fluid tight seal between the body and the mandrel above the dampening means, and floating seal means for providing a flulid tight seal between the body and the mandrel below the dampening means, the improvement comprising said body having a radial fluid outlet slightly below the floating seal means;

primary annular seal means for providing a fluid tight seal between the body and mandrel below the floating seal means; and secondary annular seal means positioned between the body and mandrel and the floating seal means and said primary seal means, said secondary seal means comprising an annular piston slidably positioned between the body and the mandrel and said radial fluid outlet and said primary seal means, said annular piston being slidable between first and second positions proximate and remote from said primary annular seal means, inner and outer annular seals positioned between said annular piston and the mandrel and the body, respectively, said annular piston being provided with an orifice to facilitate low fluid flow rates through said piston and said radial fluid outlet without causing said piston to move from said first position to said second position, and orifice seal means for sealing said orifice when said piston is in said second position.

* * * * *